US009054430B2

(12) United States Patent
Sakamoto

(10) Patent No.: US 9,054,430 B2
(45) Date of Patent: Jun. 9, 2015

(54) CONNECTION TERMINAL

(71) Applicant: YAZAKI CORPORATION, Minato-ku, Tokyo (JP)

(72) Inventor: Nobuyuki Sakamoto, Makinohara (JP)

(73) Assignee: Yazaki Corporation, Tokyo (JP)

( * ) Notice: Subject to any disclaimer, the term of this patent is extended or adjusted under 35 U.S.C. 154(b) by 167 days.

(21) Appl. No.: 13/932,103

(22) Filed: Jul. 1, 2013

(65) Prior Publication Data

US 2014/0004756 A1 Jan. 2, 2014

(30) Foreign Application Priority Data

Jul. 2, 2012 (JP) ..... 2012-148347
Jul. 3, 2012 (JP) ..... 2012-149397
Jul. 3, 2012 (JP) ..... 2012-149403

(51) Int. Cl.

*H01R 9/22* (2006.01)
*H01R 4/16* (2006.01)
*H01R 13/422* (2006.01)
*H01R 31/08* (2006.01)
*H01R 43/16* (2006.01)

(52) U.S. Cl.

CPC ..... *H01R 4/16* (2013.01); *H01R 13/4223* (2013.01); *H01R 31/08* (2013.01); *H01R 43/16* (2013.01)

(58) Field of Classification Search

CPC ..... H01R 4/489; H01R 4/4872; H01R 13/26; H01R 13/36; H01R 31/00; H01R 31/02; H01R 2101/00

USPC ..... 439/708, 723, 189

See application file for complete search history.

(56) References Cited

U.S. PATENT DOCUMENTS

| | | | | |
|---|---|---|---|---|
| 3,193,795 | A * | 7/1965 | Krehbiel | 439/708 |
| 3,942,860 | A * | 3/1976 | McDonough | 439/708 |
| 3,951,498 | A * | 4/1976 | Michaels et al. | 439/708 |
| 4,084,872 | A * | 4/1978 | Pritulsky | 439/513 |
| 4,753,613 | A * | 6/1988 | Morgan | 439/701 |
| 7,252,564 | B1 | 8/2007 | Morello et al. | |

FOREIGN PATENT DOCUMENTS

| | | | |
|---|---|---|---|
| CN | 1992442 | A | 7/2007 |
| CN | 101192724 | A | 6/2008 |
| JP | 61-68487 | U | 5/1986 |
| JP | 2003-45543 | A | 2/2003 |
| JP | 2007-87810 | A | 4/2007 |

OTHER PUBLICATIONS

Communication dated Mar. 18, 2015 from the State Intellectual Property Office of the People's Republic of China in counterpart application No. 201310272091.X.

* cited by examiner

*Primary Examiner* — Hien Vu
(74) *Attorney, Agent, or Firm* — Sughrue Mion, PLLC

(57) ABSTRACT

A connection terminal includes a box-shaped terminal body, a male contact piece protruding from a first side wall of the terminal body, a female contact portion arranged inside of the terminal body, a slit formed in a second side wall and at least one of a front wall closing up a front opening of the terminal body and a rear wall close up a rear opening of the terminal body.

11 Claims, 12 Drawing Sheets

CONNECTION TERMINAL

BACKGROUND OF THE INVENTION

1. Field of the Invention

The present invention relates to a connection terminal formed by bending a conductive plate having a predetermined shape.

2. Description of the Related Art

Conventionally, there is known a structure for connecting a plurality of connection terminals with each other, each of the connection terminals attached to one end of a wire (see JP 2007-087810 A). This type of a connection terminal is provided by applying a bending work on a conductive plate having a predetermined shape.

In detail, the connection terminal includes a wire connection portion to be connected with a wire and a terminal body formed integrally with the wire connection portion. The terminal body is formed in a boxed shape and a front end of the terminal body is an opening.

One side wall of the terminal body is provided with a male contact portion (tongue-shaped engagement piece) bent into a L-like shape configuration. The other side wall of the terminal body is formed with a female insertion hole into which a male contact portion of an adjacent connection terminal is to be inserted.

Then, under condition of being inserted into the female insertion hole, the male contact portion of the adjacent connection terminal is adapted so as to make contact with a female contact portion formed in the terminal body of the connection terminal. Thus, the male contact portion is brought into contact with the female contact portion of the adjacent connection terminal through the female insertion hole, so that two adjacent connection terminals are electrically connected with each other.

SUMMARY OF THE INVENTION

However, as the front end of the terminal body is opened in the conventional connection terminal, it has a problem that the terminal body may be deformed due to an external force applied on the terminal body.

Among connection terminals each manufactured by bending a conductive plate having a predetermined shape, therefore, an object of the present invention is to provide a connection terminal which would be hardly deformed even if an external force is applied on the terminal body.

In order to solve the problem described above, a connection terminal according to a first aspect of the present invention, manufactured by bending a conductive plate having a predetermined shape, includes: a terminal body formed in a box-like shape, the terminal body having a first side wall and a second side wall laterally-opposed to the first side wall; a male contact piece formed to protrude from the first side wall; a female contact portion arranged inside of the terminal body; a slit formed on the second side wall; and at least one of a front wall formed so as to close up a front opening of the terminal body and a rear wall formed so as to close up a rear opening of the terminal body, the front wall and the rear wall extending along a direction intersecting with the extending direction of the terminal body.

The slit may be formed so as to penetrate through the terminal body along the extending direction of the terminal body. The front wall may be provided with a cutout formed in a position in the same level with the slit to allow a passage of the male contact piece of an adjacent connection terminal.

The terminal body may include a top wall formed continuously with the first side wall and the second side wall to extend along the extending direction of the terminal body, and a bottom wall opposed to the top wall. The front wall may be provided by bending a portion of the top wall. The front wall may be provided with a front end turned-back portion folded to an outside of the bottom wall. In this case, at least one of a bent part between the front wall and the top wall and a bent part between the front wall and the front end turned-back portion may be provided with a curvature or a chamfer. Further, the bottom wall may be provided with a protrusion formed so as to protrude toward a position corresponding to a thickness of the front end turned-back portion outward. Still further, the bottom wall may be provided with an inclined piece formed so as to incline toward the front end turned-back portion.

The rear wall may be provided with a cutout formed so as to connect with the slit.

The rear wall may be formed so that a front end of the rear wall pinches one of respective walls forming the terminal body.

At least one of the first side wall and the second side wall may be followed by a bent piece folded into the terminal body to be touchable with the front wall. In this case, the terminal body may include a top wall formed continuously with the first side wall and the second side wall to extend along the extending direction of the terminal body, and a bottom wall opposed to the top wall. The front wall may be provided by bending a portion of the top wall. The front wall may be followed by a front end turned-back portion folded toward the bottom wall. The bent piece may come into contact with the front end turned-back portion. Additionally, the front end turned-back portion may be arranged in a same plane with the bottom wall.

In accordance with the first aspect of the present invention, among the connection terminals each manufactured by bending a conductive plate having a predetermined shape, it is possible to provide a connection terminal which would be hardly deformed even when an external force is applied on the terminal body.

DESCRIPTION OF THE EMBODIMENTS

Figure 1:
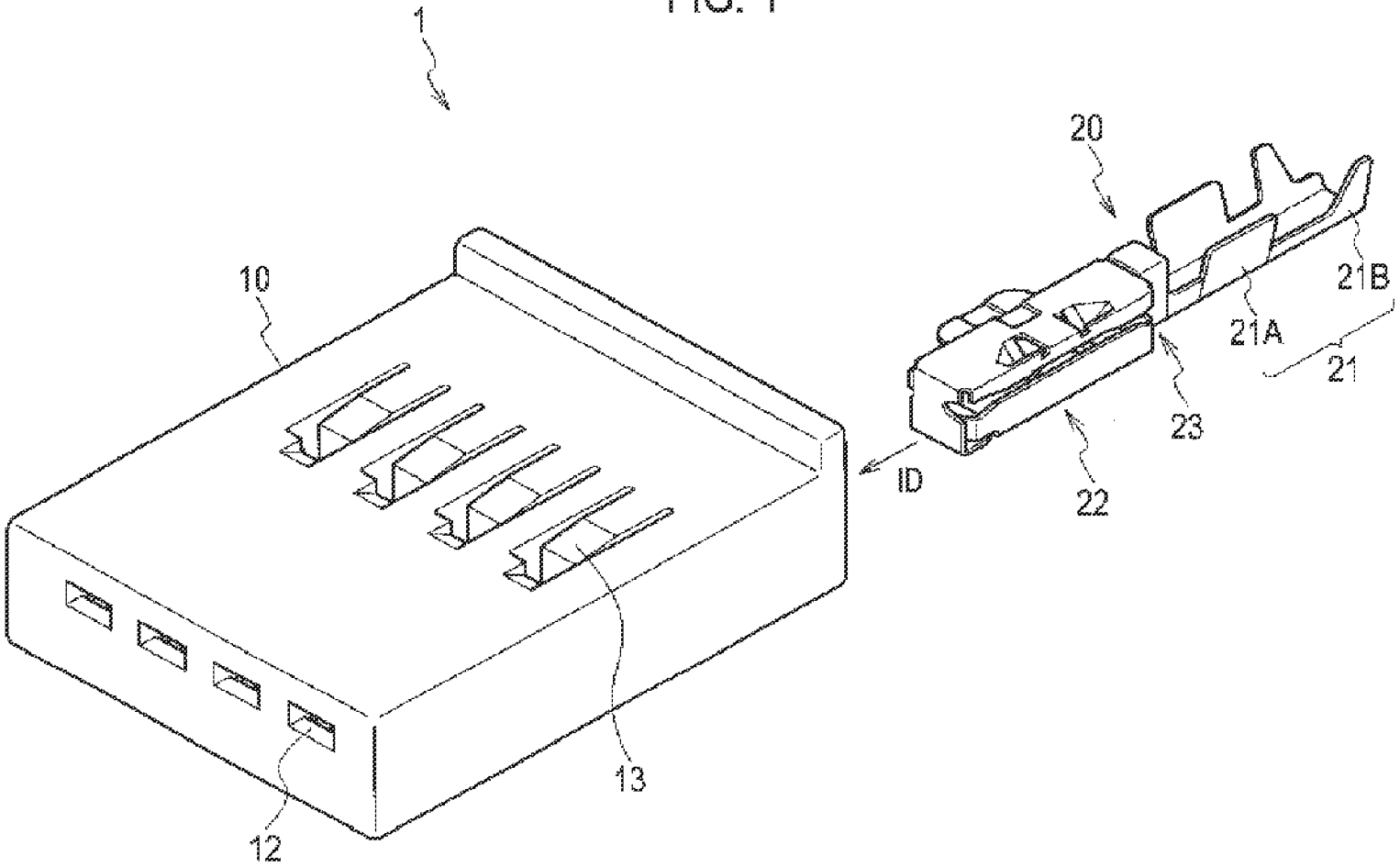
FIG. 1 is an exploded perspective view of a connector according to a first embodiment.

A connector having connection terminals according to embodiments of the present invention will be explained with reference to the drawings. In the following description of the drawings, the same or similar reference numerals or signs will be affixed to the same or similar portions. However, it should be noted that the drawings are schematic and, therefore, ratios or the like of each dimension are different from those of the actual ones. Thus, specific dimensions or the like should be determined by referring to the following explanation. Further, among the drawings, portions having mutually different dimensional relations or mutually different dimensional ratios may be included.

(First Embodiment)

The constitution of a connector 1 according to a first embodiment will be explained with reference to FIGS. 1 to 6.

Figure 2:
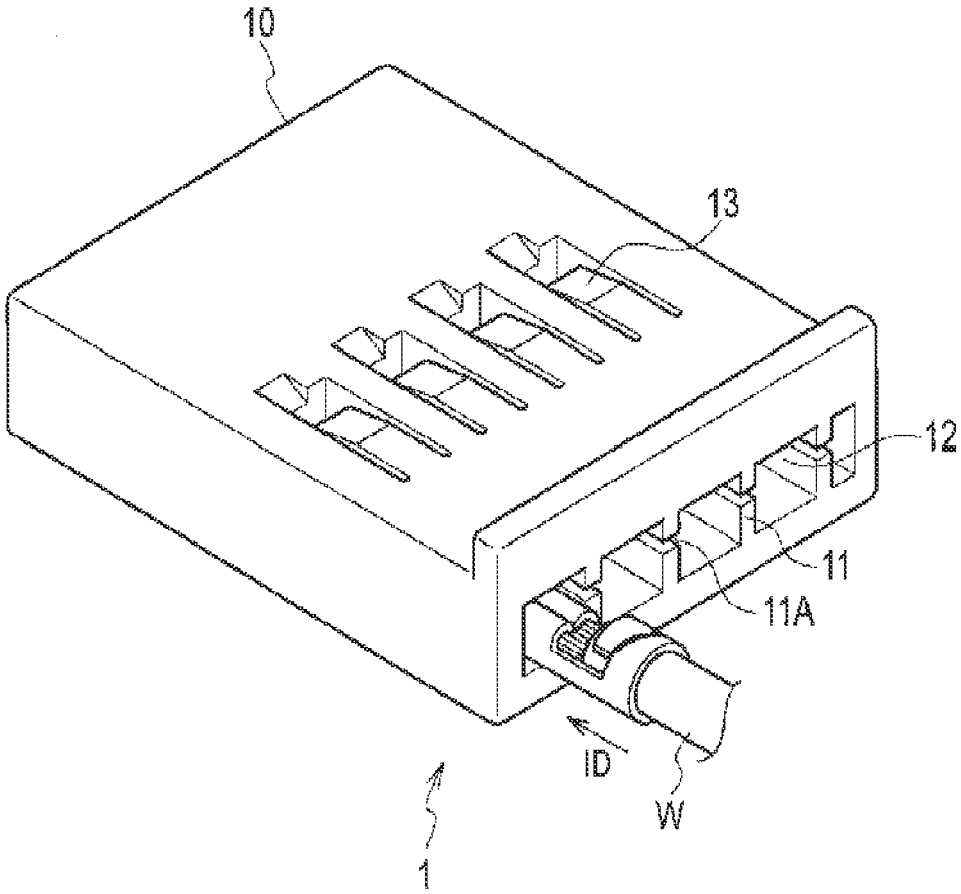
FIG. 2 is an assembling perspective view of the connector according to the first embodiment.
Figure 3:
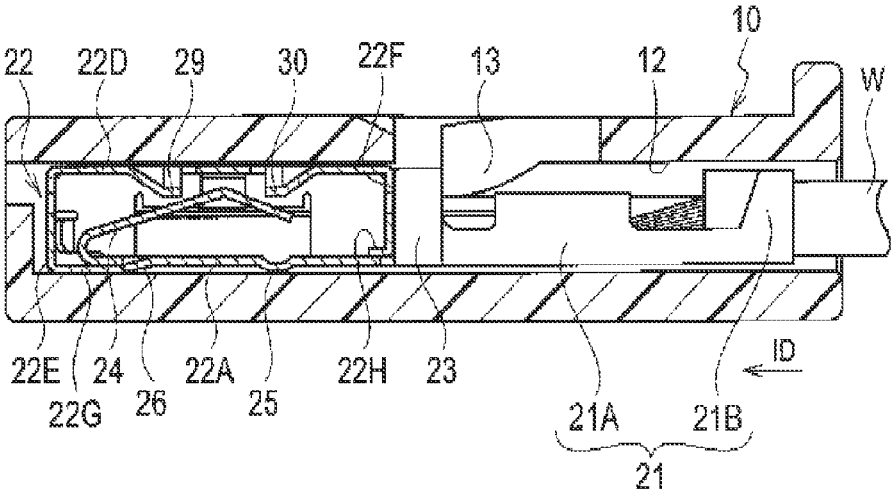
FIG. 3 is a sectional view of the connector according to the first embodiment.
Figure 4A:
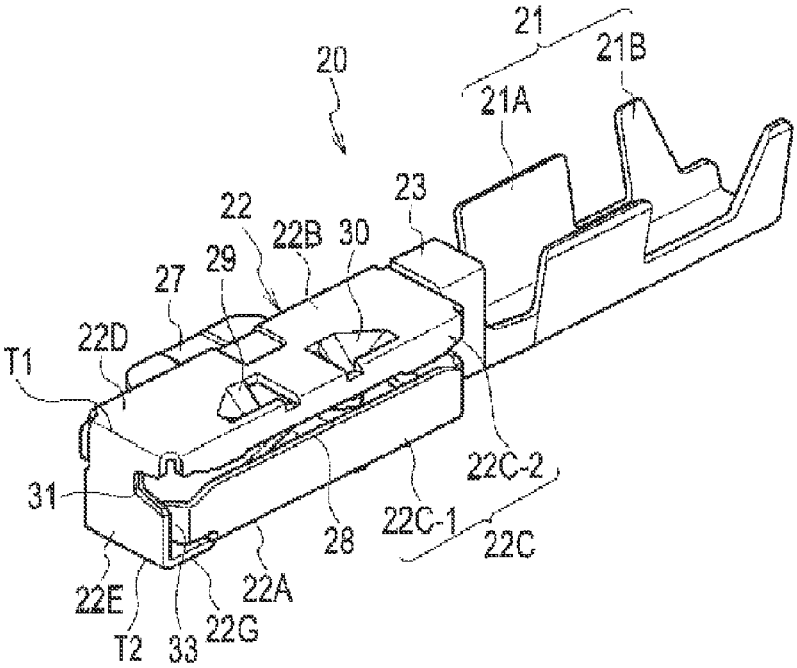
FIGS. 4A and 4B are perspective views of a connection terminal according to the first embodiment, viewed from the side of a top wall of the terminal.
Figure 4B:
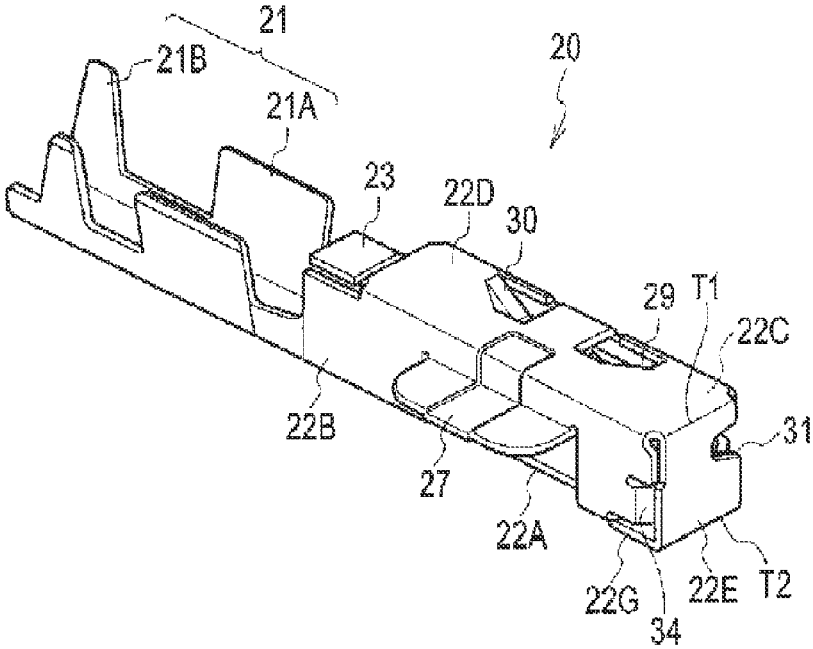
Figure 5A:
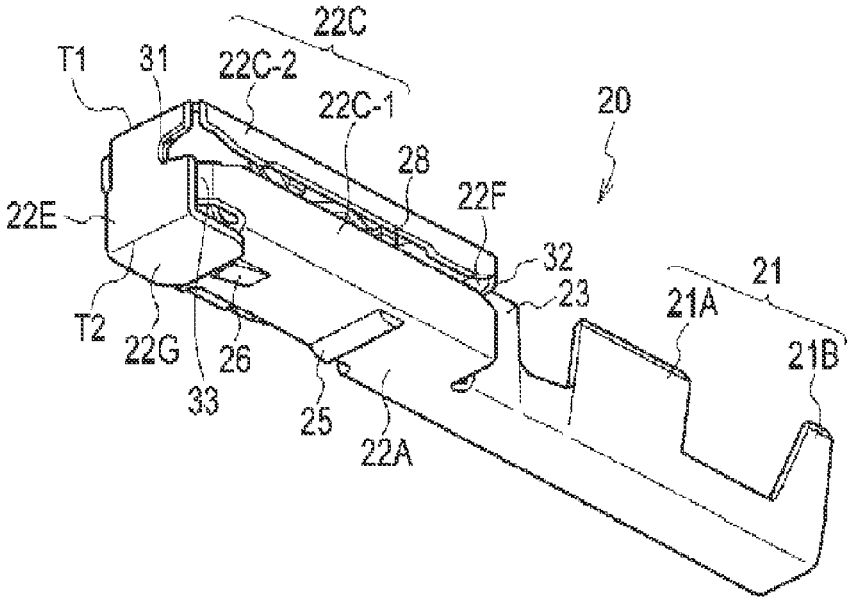
FIGS. 5A and 5B are perspective views of the connection terminal of the first embodiment, viewed from the side of a bottom wall of the terminal.
Figure 5B:
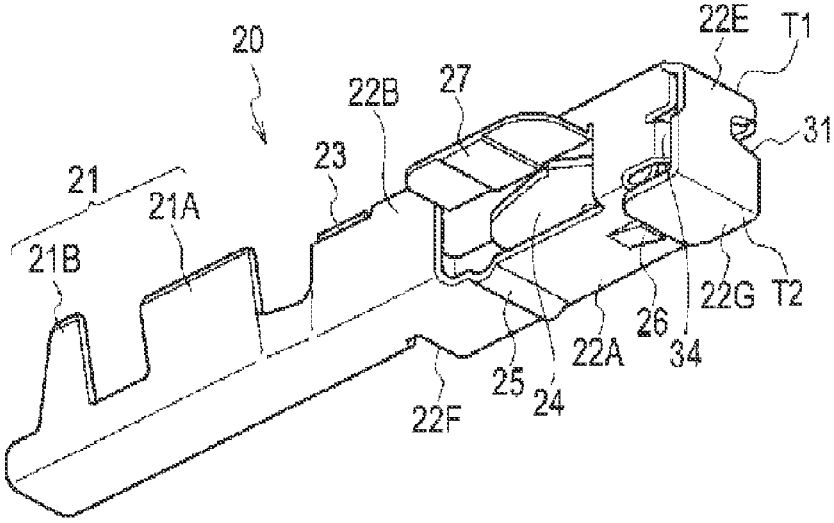
Figure 6:
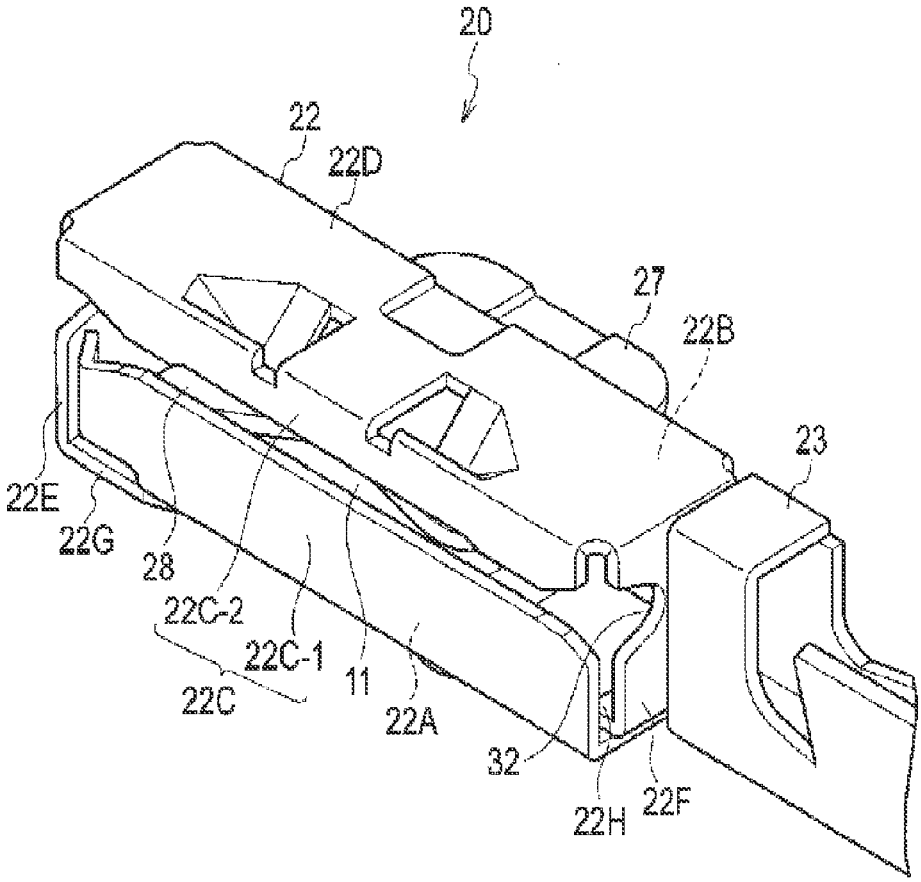
FIG. 6 is a perspective view of a terminal body of the connection terminal according to the first embodiment, viewed from a rear end of the part.

As illustrated in FIGS. 1 to 3, the connector 1 includes a housing 10 and a plurality of connection terminals 20 accommodated in the housing 10, and electrically connects each of the connection terminals 20 inserted into the housing 10. In FIGS. 1 and 2, there is illustrated only one connection terminal 20 while omitted the other connection terminals.

The housing 10 includes a plurality of chambers 12 which are partitioned by partition walls 11 respectively. Each of the partition walls 11 is provided with a communication groove 11A communicating the adjacent chambers 12 with each other. The communication groove 11A is arranged in a position deviating from a center of each of the chambers 12 in the vertical direction (e.g. upper side in the first embodiment).

A plurality of lances 13 are formed integrally with the housing 10. Each of the lances 13 is formed so as to protrude into each of the chambers 12 in a displaceable manner.

Figure 7:
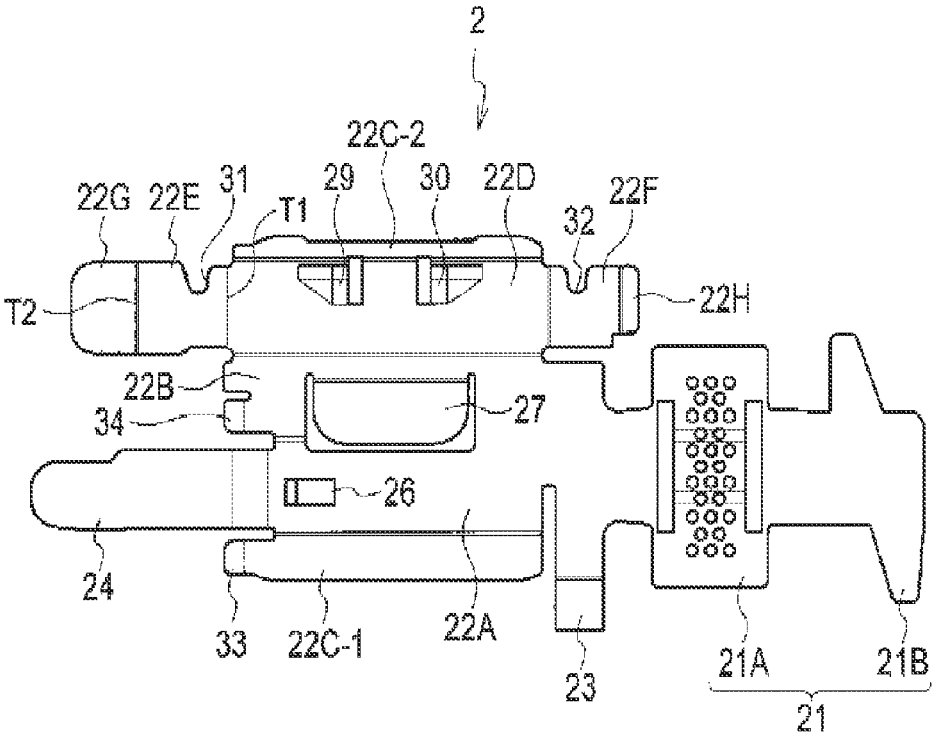
FIG. 7 is a development view of a conductive plate having a predetermined shape, which forms the connection terminal according to the first embodiment.

The connection terminal 20 is provided by bending a conductive plate 2 having a predetermined shape as illustrated in FIG. 7. The connection terminal 20 includes a wire connection portion 21 to be connected with a wire W (see FIGS. 3 and 4), a box-shaped terminal body 22 formed integrally with the wire connection portion 21, and a lance engagement portion 23 arranged on a side of the terminal body 22 closer to the wire connection portion 21 and to be engaged with the lance 13.

The wire connection portion 21 includes a core crimp portion 21A for crimping a core of the wire W and an insulation crimp portion 21B for crimping an insulation covering the core of the wire W. In order to avoid a contact with a male contact piece 27 of an adjacent connection terminal 20 when the connection terminal 20 is inserted into the housing 10, the wire connection portion 21 is unevenly arranged to one side wall of the terminal body 22 (closer to a first side wall 22B, in the first embodiment).

The terminal body 22 is arranged along a direction extending from a front end toward a rear end of the connection terminal 20. Note, this direction will be referred to as "inserting direction ID" of the connection terminal 20 into the housing 10. The terminal body 22 includes a bottom wall 22A a first side wall 22B, a second side wall 22C, and a top wall 22D, each extending along the inserting direction ID of the connection terminal 20, and a front wall 22E and rear wall 22F both extending in a direction intersecting with the inserting direction ID of the connection terminal 20.

An elastic portion 24 is formed integrally with the bottom wall 22A, in the form of a cantilever folded back from the front end side of the connection terminal 20 in the inserting direction ID. In the terminal body 22, the elastic portion 24 constitutes a female contact portion for contacted with a male contact piece 27 of the adjacent connection terminal 20.

The bottom wall 22A includes a protrusion 25 protruding outward of the bottom wall 22A and an inclined piece 26 arranged the front side of the protrusion 25 in the inserting direction ID of the connection terminal 20 into the housing 10. In order to ensure the balancing of the connection terminal 20 in the housing 10, the protrusion 25 is formed so as to protrude toward a position corresponding to the thickness of a front end turned-back portion 22G bent from the front wall 22E (i.e. a thickness of the conductive plate). The inclined piece 26 is inclined toward the front end turned-back portion 22G, preventing it from getting stuck with the chamber 12 in withdrawing the connection terminal 20 from the housing 10.

The first side wall 22B is provided with a male contact piece 27 protruding therefrom by bending a portion of the first side wall 22B outward in a horizontal direction. Corresponding to the communication groove 11A, the male contact piece 27 is arranged in a position deviating from a center of the first side wall 22B in the vertical direction (e.g. on the top wall 22D side of the first side wall 22B in the first embodiment). When the connection terminal 20 is fitted to the housing 10, the male contact piece 27 is inserted into the communication groove 11A.

The first side wall 22B is followed by a first bent piece 34 which can be obtained by bending a front edge portion of the first side wall 22B into the terminal body 22 and which can make contact with the front wall 22E.

The second side wall 22C is opposed to the first side wall 22B. The second side wall 22C includes a lower second side wall 22C-1 obtained by bending a periphery of the bottom wall 22A and an upper second side wall 22C-2 obtained by bending a periphery of the top wall 22D. The lower second side wall 22C-1 and the upper second side wall 22C-2 are separated from each other in the vertical direction.

That is, the second side wall 22C is provided with a slit 28 which allows inserting the male contact piece 27 of the adjacent connection terminal 20. In the second side wall 22C, the slit 28 is formed so as to penetrate through the terminal body 22 along the inserting direction ID. Similarly to the male contact piece 27, the slit 28 is arranged in a position deviating from the center of the second side wall 22C in the vertical direction, corresponding to the communication groove 11A (e.g. on one side of the second side wall 22C closer to the top wall 22D in the first embodiment). On both sides of the slit 28 in the inserting direction ID, it is formed so as to gradually increase a slit width as directing to the outside (i.e. toward the front wall 22E and the rear wall 22F) from the center of the second side wall 22C.

The lower second side wall 22C-1 is followed by a second bent piece 33 which can be obtained by bending a front edge portion of the lower second side wall 22C-1 into the terminal body 22 and which can make contact with the front wall 22E.

The top wall 22D is provided by bending a portion of the first side wall 22B. The top wall 22D is provided with a first contact portion 29 and a second contact portion 30 each protruding toward the inner side of the terminal body 22. Similarly to the elastic portion 24, the first contact portion 29 and the second contact portion 30 arranged in the terminal body 22 to constitute the female contact portion for contact with the male contact piece 27.

Accordingly, when the connection terminal 20 is fitted to the housing 10, the male contact piece 27 is inserted into the slit 28 of the adjacent terminal body 22 through the communication groove 11A and successively pinched between the elastic portion 24 and the first and second contact portions 29, 30 as the female contact portion. Consequently, two adjacent connection terminals 20 are electrically connected with each other.

The front wall 22E is arranged at the front end of the terminal body 22 in the inserting direction ID to close up a front opening of the terminal body 22. The front wall 22E is provided by bending a portion of the top wall 22D. The front wall 22E is followed by the front end turned-back portion 22G folded back to an outer side of the bottom wall 22A to abut on it. A bent part T1 between the front wall 22E and the top wall 22D and a bent part T2 between the front wall 22E and the front end turned-back portion 22G are respectively provided with curvatures or chamfers.

The rear wall 22F is positioned on the rear side of the front wall 22E in the inserting direction ID to close up a rear opening of the terminal body 22. The rear wall 22F is provided by bending a portion of the top wall 22D. The rear wall 22F is followed by a rear end turned-back portion 22H folded back to the inner side of the bottom wall 22A to abut on it.

The front wall 22E is provided with a first cutout 31 in a position along the slit 28. The rear wall 22F is provided with a second cutout 32 in a position along the slit 28. The first and second cutouts 31, 32 are formed so as to allow a passage of the male contact piece 27 therethrough, respectively. The first and second cutouts 31, 32 are formed so as to correspond to respective positions of the male contact piece 27 and the slit 28. The first and second cutouts 31, 32 are formed so as to open against the slit 28 and become narrower gradually as directing from the second side wall 22C to the first side wall 22B.

The assembling method of the connector 1 of the first embodiment will be described in brief.

First, insert the connection terminal 20 into one of the chambers 12 of the housing 10. Then, the male contact piece 27 is gradually inserted into the slit 28 of the adjacent connection terminal 20 through the communicating groove 11A of the housing 10 and the second cutout 32 of the adjoining connecting terminal 20.

Subsequently, when the connection terminal 20 is completely fitted in the housing 10 (see FIGS. 2 and 3), the male contact piece 27 is pinched between the elastic portion 24 and the first and second contact portions 29, 30. Consequently, two adjacent connection terminals 20 are electrically connected with each other.

During this inserting, since the bent parts T1, T2 are respectively provided with curvatures or chamfers, there is no possibility of conflict between the housing 10 and angular parts of the connection terminal 20, it is possible to prevent the insertability of the connection terminal 20 into the housing 10 from deteriorating.

Repeatedly, the connection terminal 20 is provided with the front wall 22E closing up the front opening of the terminal body 22 and the rear wall 22F closing up the rear opening of the terminal body 22. Owing to the provision of the front wall 22E and the rear wall 22F, both ends of the terminal body 22 is reinforced to improve the rigidity of the terminal body 22. Thus, even if an external force is applied to the connection terminal 20, the deformation of the terminal body 22 could be avoided due to its enhanced rigidity.

The first side wall 22B is followed by the first bent piece 34 bent into the terminal body 22 to be touchable with the front wall 22E. The lower second side wall 22C-1 is followed by the second bent piece 33 bent into the terminal body 22 to be touchable with the front wall 22E. Owing to the provision of the first bent piece 34 and the second bent piece 33, the front end of the terminal body 22 is reinforced to improve the rigidity of the terminal body 22. Accordingly, even if an external force is applied to the connection terminal 20 (e.g. when the front end of the terminal body 22 makes contact with the housing 10), the deformation of the terminal body 22 could be avoided due to its enhanced rigidity.

The front wall 22E is formed with the first cutout 31 allowing a passage of the male contact piece 27. Consequently, in inserting the male contact piece 27 of the connection terminal 20 into the slit 28 of the adjacent connection terminal 20, it is possible to prevent the male contact piece 27 from abutting against the front wall 22E of the adjacent connection terminal 20. Thus, the male contact piece 27 can be inserted into the slit 28 smoothly, facilitating the connecting operation of the adjacent connection terminals 20.

The rear wall 22F is formed with the second cutout 32 allowing a passage of the male contact piece 27. Consequently, the male contact piece 27 of the connection terminal 20 can be easily inserted into the slit 28 of the adjacent connection terminal 20.

The front wall 22E is followed by the front end turned-back portion 22G folded back to the outer side of the bottom wall 22A to abut on it. Thus, the front end of the terminal body 22 is further reinforced in comparison with an arrangement where the front end turned-back portion 22G is not provided, so that the rigidity of the terminal body 22 is improved furthermore.

The rear wall 22F is followed by the rear end turned-back portion 22H folded back to the inner side of the bottom wall 22A to abut on it. Thus, the rear end of the terminal body 22 is further reinforced in comparison with an arrangement where the rear end turned-back portion 22H is not provided, so that the rigidity of the terminal body 22 is improved furthermore.

The bent part T1 and the bent part T2 are provided with curvatures or chamfers, respectively. Consequently, when inserting the connection terminal 20 into the housing 10, there is no possibility that angular parts of the connection terminal 20 collide with the housing 10, so that deterioration in the insertability of the connection terminal 20 into the housing 10 can be avoided.

On the bottom wall 22A, the protrusion 25 is formed so as to protrude toward a position corresponding to the thickness of a front end turned-back portion 22G. Consequently, it is possible to ensure the balancing of the connection terminal 20 accommodated in the housing 10, allowing the connection between the adjacent connection terminals 20 to be stabilized.

On the bottom wall 22A, the inclined piece 26 is formed so as to incline toward the front end turned-back portion 22G. Consequently, it is possible to prevent the front end turned-back portion 22G from getting stuck with the chamber 12 in withdrawing the connection terminal 20 from the housing 10, so that deterioration in the detachability of the connection terminal 20 from the housing 10 can be avoided.

(First Modification)

A connection terminal 20A in a first modification differs from the connection terminal of the first embodiment only in the constitution of the rear end turned-back portion 22H. The other constitutions are similar to those of the first embodiment, and therefore their descriptions are omitted.

Figure 8:
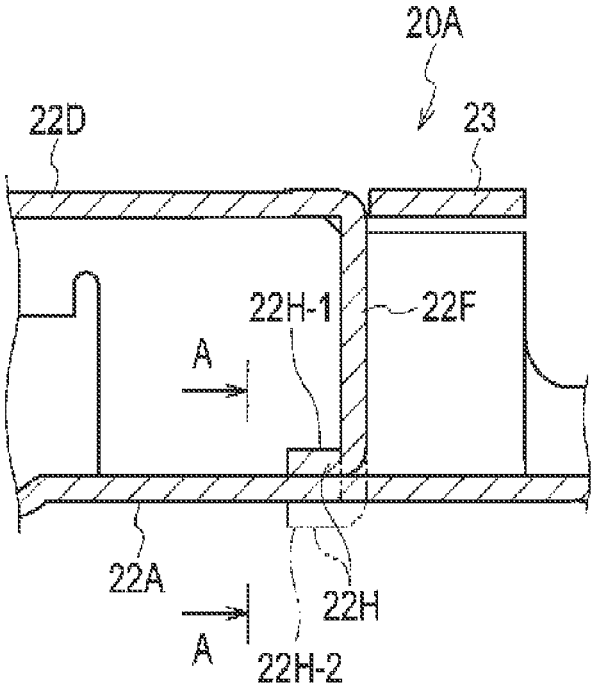
FIG. 8 is a partial sectional view of a schematic constitution of the connection terminal according to a first modification, taken along an orthogonal plane in the horizontal direction.
Figure 9:
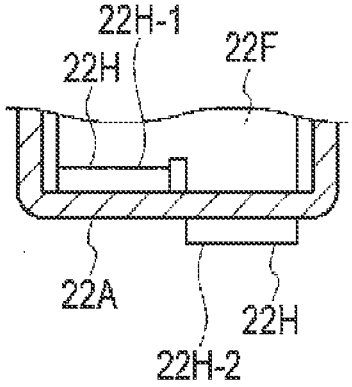
FIG. 9 is a view taken along a line A-A of FIG. 8.

In the connection terminal 20A of the first modification, as illustrated in FIGS. 8 and 9, the rear end turned-back portion 22H is divided in the width direction into two parts, that is, an inner rear end turned-back portion 22H-1 and an outer rear end turned-back portion 22H-2 between which the bottom wall 22A is pinched.

In detail, the inner rear end turned-back portion 22H-1 is positioned inside the terminal body 22 and further laid on the bottom wall 22A in the contact state. Meanwhile, the outer rear end turned-back portion 22H-2 is positioned outside the terminal body 22 and further laid on the bottom wall 22A in the contact state.

In a variation of the first modification, the rear end turned-back portion 22H may be divided in the width direction into three or more parts by which the bottom wall 22A is pinched.

In this way, by constructing the rear end turned-back portion 22H so as to pinch the bottom wall 22A, the rigidity of the terminal body 22 is further improved and it is possible to prevent the terminal body 22 from being deformed.

(Second Modification)

Figure 10:
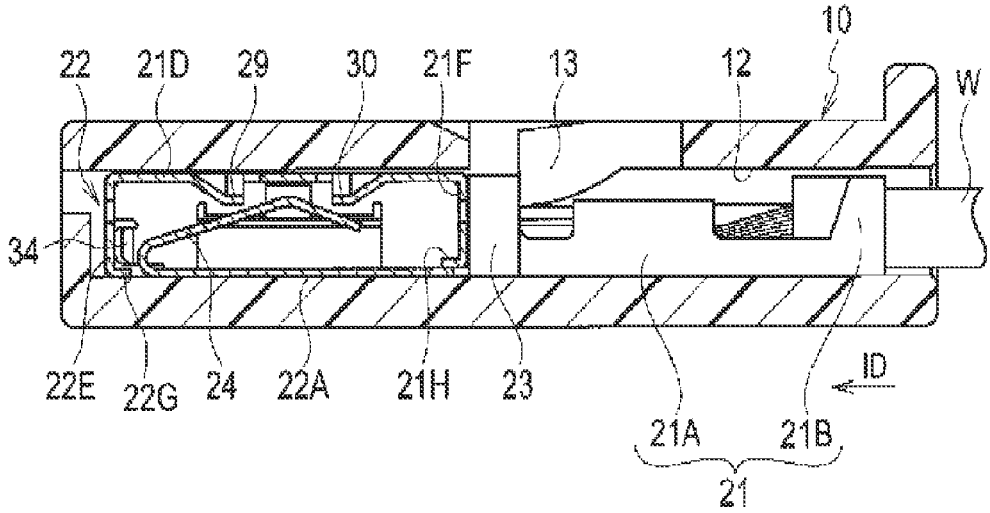
FIG. 10 is a sectional view of a connector according to a second modification.
Figure 11A:
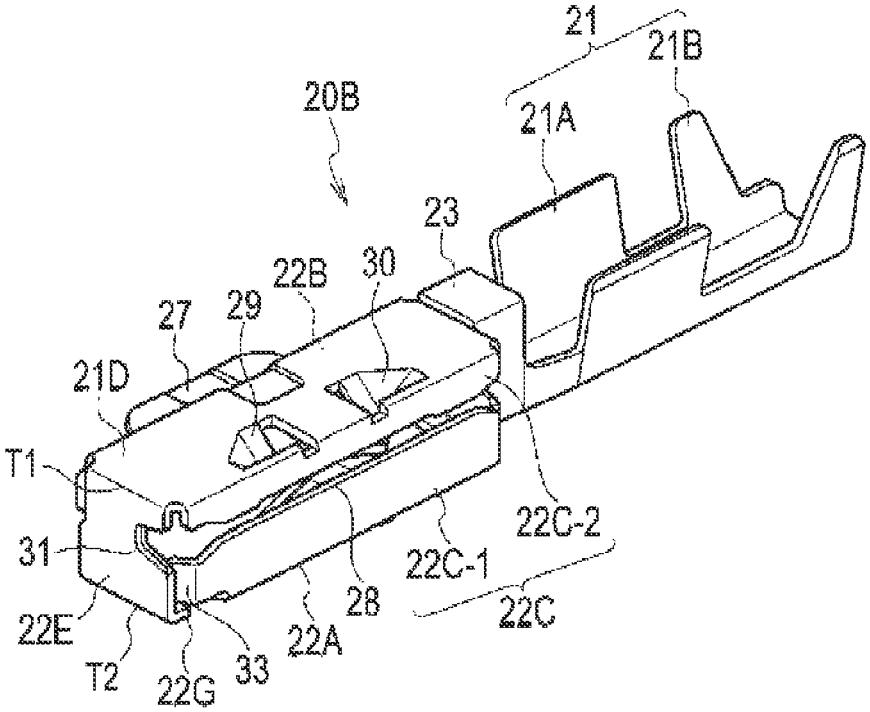
FIGS. 11A and 11B are perspective views of the connection terminal according to the second modification, viewed from the side of a top wall of the terminal.
Figure 11B:
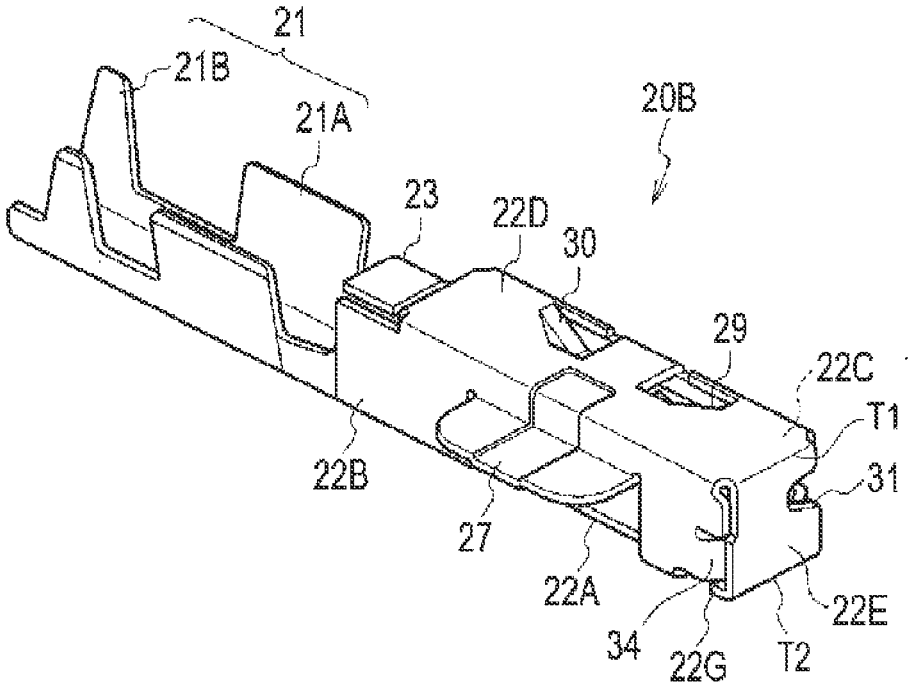
Figure 12A:
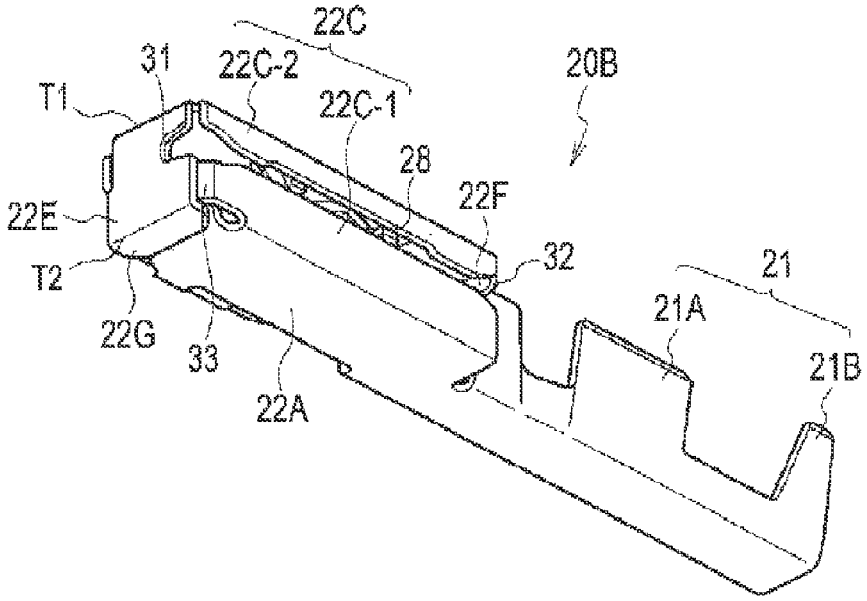
FIGS. 12A and 12B are perspective views of the connection terminal according to the second modification, viewed from the side of a bottom wall of the terminal.
Figure 12B:
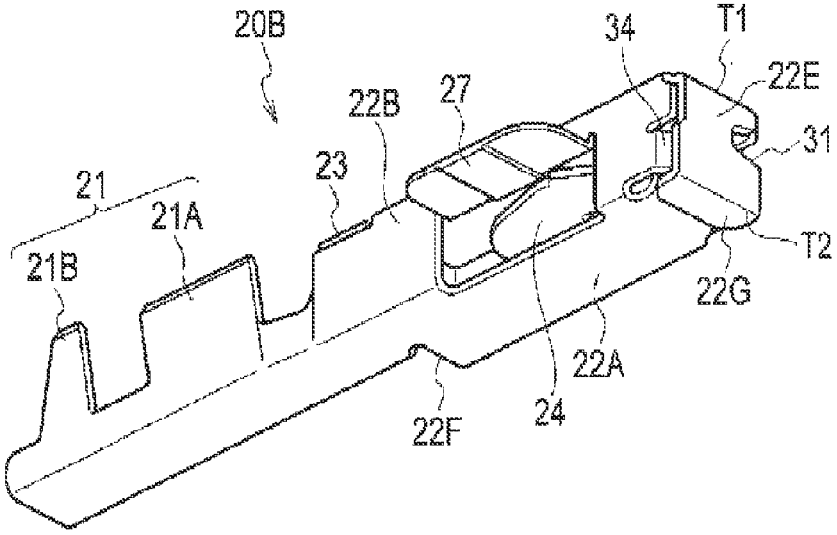

A connection terminal 20B in a second modification is illustrated in FIGS. 10 to 12.

In the connection terminal 20B of the second modification, the front end turned-back portion 22G is arranged in a same plane with the bottom wall 22A. Thus, the protrusion 25 and the inclined piece 26 of the first embodiment are omitted in the second modification. Additionally, in the second modification, the first bent piece 34 and the second bent piece 33 are adapted so as to be touchable with the front end turned-back portion 22G. The other constitutions are similar to those of the first embodiment.

Figure 13:
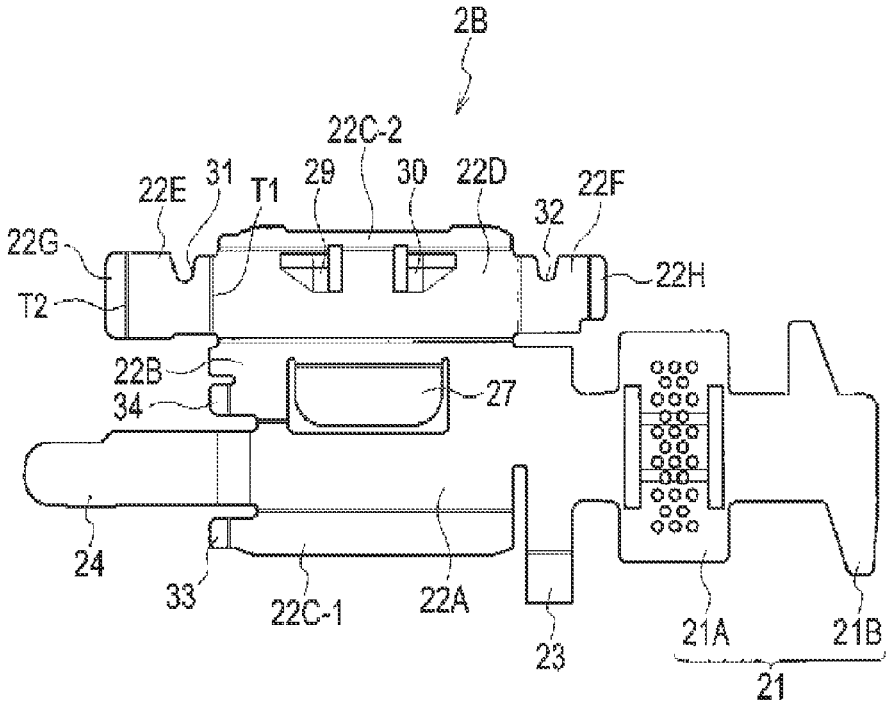
FIG. 13 is a development view of the conductive plate having a predetermined shape, which forms the connection terminal of the second modification.

The connection terminal 20B is provided by bending a conductive plate 2B having a predetermined shape illustrated in FIG. 13.

In the connection terminal 20B according to the second modification, repeatedly, the first bent piece 34 and the second bent piece 33 are formed so as to be touchable with the front end turned-back portion 22G. Consequently, even if an external force is applied to the terminal body 22 to open it, for example, at the assembling operation of the wire, the first bent piece 34 and the second bent piece 33 would be hooked by the front end turned-back portion 22G. Thus, it is possible to prevent the terminal connection portion 22 from being not only crushed but also opened in deformation.

Repeatedly, the front end turned-back portion 22G is arranged in the same plane with the bottom wall 22A. Consequently, it is possible to ensure the balancing of the connection terminal 20B accommodated in the housing 10, allowing the connection between the adjacent connection terminals 20B to be stabilized. Additionally, it is possible to prevent the front end turned-back portion 22G from getting stuck with the chamber 12 in withdrawing the connection terminal 20B from the housing 10, so that deterioration in the detachability of the connection terminal 20B from the housing 10 can be avoided.

(Other Embodiments)

As described above, although the contents of the present invention has been disclosed through the exemplary embodiments, the descriptions and drawings constituting a part of this disclosure should not be understood as ones limiting the present invention. From this disclosure, various alternative embodiments and operational techniques would be apparent to those skilled in the art.

For instance, the embodiments of the present invention may be altered as follows. In detail, the configuration of the connector 1 is not limited to that described in the illustrated embodiment and therefore, it may be established appropriately. That is, the housing 10 and the connection terminal 20 may be also modified in shape appropriately.

The communication groove 11A is not necessarily to be formed on the upper side of the vertical center of the chamber 12 and therefore, it may be formed at the vertical center of the chamber 12 or on the lower side of the vertical center. In connection, the male contact piece 27, the slit 28 and the first and second cutouts 31, 32 have only to be formed corresponding to the position of the communication grooves 11A.

The wire connection portion 21 is not necessarily to be unevenly arranged to one side wall of the terminal body 22 (closer to the first side wall 22B). The wire connection portion 21 may be arranged so as not to deviate from the terminal body 22.

In this way, it is matter of course that the present invention contains a variety of embodiments undescribed herein. Accordingly, the technical scope of the present invention would be defined only by inventive specific matters related to claims reasonable from the above description.

What is claimed is:

1. A connection terminal manufactured by bending a conductive plate having a predetermined shape, comprising:

a terminal body formed in a box-like shape, the terminal body having a first side wall and a second side wall laterally-opposed to the first side wall;

a male contact piece formed to protrude from the first side wall;

a female contact portion arranged inside of the terminal body;

a slit formed on the second side wall; and at least one of a front wall formed and extended from a top wall to a bottom wall of the terminal body so as to close up substantially completely a front opening of the terminal body and a rear wall formed and extended from a top wall to a bottom wall of the terminal body so as to close up substantially completely a rear opening of the terminal body, the front wall and the rear wall extending along a direction intersecting with the extending direction of the terminal body;

wherein the slit is formed so as to penetrate through the terminal body along the extending direction of the terminal body.

2. The connection terminal of claim 1, wherein

[the slit is formed so as to penetrate through the terminal body along the extending direction of the terminal body, and] the front wall is provided with a cutout formed in a position in the same level with the slit to allow a passage of the male contact piece of an adjacent connection terminal.

3. The connection terminal of claim 1, wherein the terminal body includes a top wall formed continuously with the first side wall and the second side wall to extend along the extending direction of the terminal body, and a bottom wall opposed to the top wall, the front wall is provided by bending a portion of the top wall, and the front wall is provided with a front end turned-back portion folded to an outside of the bottom wall.

4. The connection terminal of claim 3, wherein at least one of a bent part between the front wall and the top wall and a bent part between the front wall and the front end turned-back portion is provided with a curvature or a chamfer.

5. The connection terminal of claim 3, wherein the bottom wall is provided with a protrusion formed so as to protrude toward a position corresponding to a thickness of the front end turned-back portion outward.

6. The connection terminal of claim 3, wherein the bottom wall is provided with an inclined piece formed so as to incline toward the front end turned-back portion.

7. The connection terminal of claim 1, wherein the rear wall is provided with a cutout formed so as to connect with the slit.

8. The connection terminal of claim 1, wherein the rear wall is formed so that a front end thereof pinches one of respective walls forming the terminal body.

9. The connection terminal of claim 1, wherein at least one of the first side wall and the second side wall is followed by a bent piece folded into the terminal body to be touchable with the front wall.

10. The connection terminal of claim 9, wherein the terminal body includes a top wall formed continuously with the first side wall and the second side wall to extend along the extending direction of the terminal body, and a bottom wall opposed to the top wall, the front wall is provided by bending a portion of the top wall, the front wall is followed by a front end turned-back portion folded toward the bottom wall, and the bent piece comes into contact with the front end turned-back portion.

11. The connection terminal of claim 10, wherein the front end turned-back portion is arranged in a same plane with the bottom wall.

* * * * *